United States Patent [19]

Latimer

[11] 4,019,271

[45] Apr. 26, 1977

[54] METHOD FOR MANUFACTURING A DISPLAY PORTION THEREOF

[76] Inventor: Kenneth James Latimer, 1088 Garnette St., Salt Lake City, Utah 84106

[22] Filed: Oct. 6, 1975

[21] Appl. No.: 619,796

[52] U.S. Cl. ..... 40/125 H; 116/63 P

[51] Int. Cl.[2] ..... G09F 7/00

[58] Field of Search ..... 40/128, 125 F, 125 G, 40/125 H, 125 R; 248/472, 165; 116/63, 63 P

[56] References Cited

UNITED STATES PATENTS

| | | | |
|---|---|---|---|
| 927,966 | 7/1909 | Hagen | 40/125 F |
| 1,575,409 | 3/1926 | Blaeser | 40/125 F |
| 2,125,994 | 8/1938 | Doering | 40/125 R X |
| 2,659,171 | 11/1953 | Hill | 40/125 F |
| 2,938,290 | 5/1960 | Burdick | 40/125 F |
| 3,141,557 | 7/1964 | Marschak | 248/165 X |
| 3,200,786 | 8/1965 | Swezy et al. | 116/63 P |
| 3,847,335 | 11/1974 | Ross | 40/125 H |
| 3,899,843 | 8/1975 | Doyle et al. | 40/125 G |

*Primary Examiner*—G.E. McNeill
*Assistant Examiner*—Wenceslao J. Contreras
*Attorney, Agent, or Firm*—M. Reid Russell

[57] ABSTRACT

A portable sign, and method for manufacturing a display portion thereof, useful on highway construction projects for alerting motorists to road repairs, hazards, and the like, that is arranged to be easily erected or taken down, with component parts that can be broken down and telescoped within a tubular mast thereof, facilitating handling and storage. The portable sign incorporates: a base, that is formed to receive a ballast material therein; a tubular mast for releasable coupling to that base; a cap for installation on top of the mast; a cross arm that can be installed to approximately a midpoint of the mast, extending across the mast at a normal angle thereto, and a display portion. The erected mast and cross arm support the sign display portion having a background formed from an open weave or perforated section of material having secured thereon, single or multiple letters, numbers, symbols, characters, or the like, the sign display portion being maintained across the erected mast and cross arm by installation of hooks attached thereto, into holes formed appropriately in that mast and cross arm.

14 Claims, 6 Drawing Figures

METHOD FOR MANUFACTURING A DISPLAY PORTION THEREOF

BRIEF DESCRIPTION OF THE INVENTION

1. Field of the Invention

This invention relates to portable highway signs and includes a method of manufacture of a sign display portion for use therewith.

2. Prior Art

Of major importance today, due to our society's dependence upon the automobile, is the continuing construction, repair, and maintenance of the nation's highways and roads. Involved in all such construction, repair, and maintenance, are warning signs for placement on the highway ahead of the job site whereby a contractor or the state can notify motorists of the presence of road construction equipment, personnel, or hazardous conditions in advance of their driving into the job site. To provide motorists with such warning, it is necessary that numerous signs be displayed along the road side, such signs being located well in advance of the road construction or repair project. Highway warning signs have, in the past, most often been constructed from wood, or have had metal bases and wood display portions attached thereto. Such sign and sign holders have obviously been heavy and bulky, are difficult to ship and store, and are often subject to damage due to their being roughly handled in loading and unloading off from and onto trucks. Such signs, because of the types of materials normally used in their construction, specifically wood and steel, are often hard to handle by road construction personnel, and may cause property damage and perhaps even loss of life to a motorist who accidently drives into such a sign.

The present invention seeks to overcome the above cited deficiencies in highway warning signs currently in use across the country, by providing a base for a sign support that is constructed from light weight material, such as molded glass fibers and resin, thermoplastic material, or metal, that is arranged to have releasably coupled thereto a mast and cross arm arrangement also preferrably manufactured from light weight materials such as plastic pipe, reinforced plastic, or metal, that can be easily erected or broken down, to support a sign display portion thereto. Also, the present invention involves a method for fabrication of the sign display portion that is unlike any method within my knowledge.

While certain other prior U.S. patents, such as U.S. Pat. Nos. 1,139,802; 2,372,111; and 2,882,629 have involved sign holder arrangements, with other devices, such as those shown in U.S. Pat. Nos. 1,307,655 and 3,119,588 having even involved collapsible sign arrangements, neither these patents nor any device within my knowledge has heretofore taught a base formed like that of the present invention; a mast having a twist lock coupling arrangement for connecting it to the base; or a sign display portion like that of the present invention. The present invention, within the knowledge of the inventor, is therefore believed to be novel and unique.

SUMMARY OF THE INVENTION

It is the principal object of the present invention to provide a portable sign constructed from light in weight materials having a display portion support structure that is capable of being easily broken down from an erected attitude allowing certain components thereof to be stored within a single mast portion thereof, but can be easily re-erected, supporting a sign display portion releasably attached thereto.

Another object is to provide a base for such portable sign that is light in weight and is easily and inexpensively formed in any one of a variety of shapes by molding, stamping, or like methods, from fiberglass, a thermoplastic material, metal, or the like, the base top surface being contoured to receive weight therein in the form of sand, rocks, or like ballast, to provide an effective ground anchor, which base is capable of being nested for storage and transport with other like bases.

Another object is to provide a sign support structure for the sign display portion thereof that can be easily erected and connected to the base by a twisting locking arrangement but can be easily removed therefrom and further disassembled to single straight components for transport or storage.

Still another object is to provide a sign display portion of a sign for attachment to a sign support structure which sign display portion has a background formed from an open weave or perforated preferrably flexible material having single or multiple symbols, letters, numers, or the like pressed, adhesively secured, or otherwise attached thereto, the sign display portion being extendable, for attachment by clip devices, or the like, across the sign support structure for display of the symbol or symbols thereon.

Still another object is to provide a method of manufacture for fabrication of a sign display portion from a section of open weave or perforated material to which material single or plural letters, numbers, characters, symbols, or the like are attached.

Principal features of the present invention in a portable sign includes a base, that is preferrably fabricated by molding, stamping, or like manufacturing methods, from light in weight, inexpensive, fiberglass, thermoplastic, metal, or the like material, the base having formed therein an arrangement of depressions, cups, or having dividers, arranged appropriately therein, to receive sand, gravel, or the like, as ballast.

Arranged in a center portion of the base is a flat area having a number of screws, bolts, or like headed devices arranged to extend outwardly therefrom, spaced approximately equidistant from one another, around the center of the base. The heads of these screws, or such like devices, are each individually intended to pass through eyelet holes formed, in spaced arrangement, in a round flange that connects across a base end of a tubular mast. The eyelet holes, in turn, each connect to a keyway such that, when the round flange is appropriately aligned over the screw heads, those screw heads will pass through the eyelet holes, and thereafter the round flange can be turned such that the keyway opposite edges will slide beneath the undersurface of the screw heads binding that round flange to the base. Secured to the round flange is a spring biased floating locking tab that is positioned with its one end over an eyelet hole to be elevated against its spring biasing when a screw head is fitted therethrough. Thereafter, as the round flange is rotated the screw head travels along the keyway and the locking tab slides over the screw head until the body of the screw reaches the end of the keyway. Whereat, the screw head has passed beyond the tab end and the spring biasing of the locking tab drops that tab end behind the screw head, thereby locking the round flange to the base, prohibiting backward rotation of that round flange. The locking tab is bent up at its opposite end such that an operator applying a slight pressure, as with his finger or foot, may elevate the locking tab away from the screw head. The round flange is thereby freed so that it can be rotated until all the screw heads align with the round flange eyelet holes, whereafter the round flange and connected mast can then be elevated off from the base.

Attached to the round flange, extending at a normal angle therefrom, is the mast. The mast is preferrably tubular fabricated from plastic pipe, reinforced plastic, metal, or the like, though other shapes of materials could obviously be used. The longitudinal opening of the preferred tubular mast is intended to accomodate therein, the sign support, a cross arm, poles whereon flags are attached and rolled, and may, if an appropriate diameter tube is utilized, accomodate also the sign display portion rolled upon itself, folded, or otherwise collapsed. The mast has a laterial hole formed therethrough, at approximately its midpoint, for receiving a cross arm installed therethrough. Also, the mast has spaced apart openings formed therein, one near to the base end whereon the round flange is attached, and the other near to the top end thereof. The cross arm also has like openings formed therein arranged near to its ends. These openings in the mast and cross arm are intended to receive hooks that are secured to the corners of the sign display portion, for connecting that sign display portion, in an extended or erected display attitude, across said mast and cross arm.

The top of the mast is arranged to receive a cap installed thereover. The cap has a plurality of individual cups secured to extend upwardly therefrom that are to receive and maintain individual ends of flagpoles therein. The mast, to support the cap thereto, has at least one, but preferrably two, open longitudinal grooves formed therein extending downward from an open top end, the groove terminating in a hole having a larger diameter than the distance across the groove. The cap has arranged therewith at least one, but preferrably two, spring loaded pin arrangements therewith such that a head end thereof is depressable into the cap, that pin arrangement having a body whose diameter is slightly less than the width of the groove and whose head end has a diameter greater than the width of the groove, but slightly less than the hole diameter. So arranged, an operator, by manually depressing the end of the pin arrangement that extends through the cap wall, against its spring biasing, urges the body and head end thereof into the cap. Whereafter, the cap can be installed over the mast top end, the pin arrangement body traveling along the groove and into the hole whereupon, the pin arrangement is released, the spring biasing urging the head end into the hole, thereby locking the cap to the mast top end. Release of the cap is accomplished by manually depressing the pin arrangement end such that the head end travels into the mast allowing the pin arrangement body to travel back up the groove.

As stated earlier herein, the sign display portion for attachment to the erected mast and cross arm is intended to consist of a background fabricated from an open weave or perforated material, of any color, which is preferrably flexible, and can be knitted or woven, a metal, synthetic, or natural material, or the like, that will allow for a passage of air. Letters, numbers, symbols, characters, or the like, and may have an adhesive backing, are attached to that background material by aligning and pressing the backs of like letters, numbers, symbols, characters, or the like, together with the background material sandwiched therebetween. Applying pressure to which letters, numbers, symbols, characters, or the like, causes their backs to flow through holes in said background material, the surfaces thereof adhering together encapsulating the sandwiched background material therebetween, to bond the letters, numbers, symbols, characters or the like, to that background. In addition to the sign support and sign display portion, the present invention also involves the process for forming the sign display portion, having single or multiple letters, numbers, symbols, characters, or the like secured thereon by the process described above.

Further objects and features of the invention will become apparent from the following detailed description taken together with the accompanying drawings.

THE DRAWINGS

Figure 1:
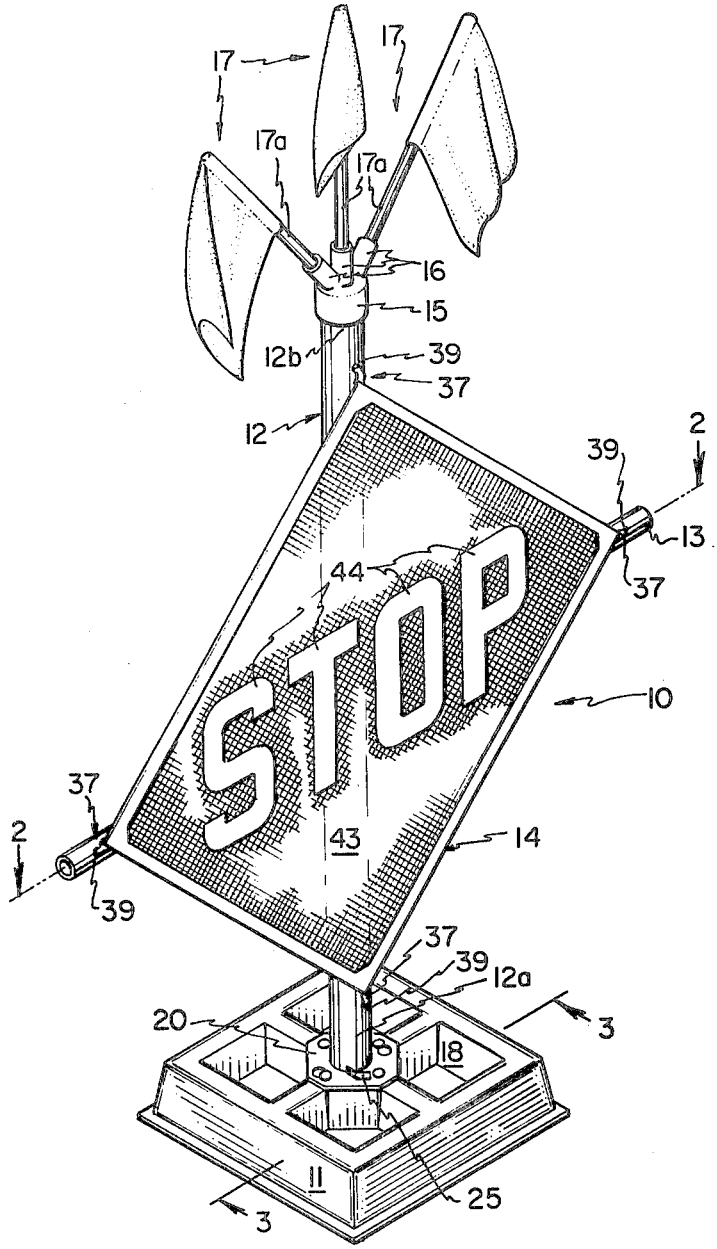
FIG. 1 is a frontal prospective view taken from the side of a portable sign of the present invention, which sign is shown in an erected attitude.
Figure 4:
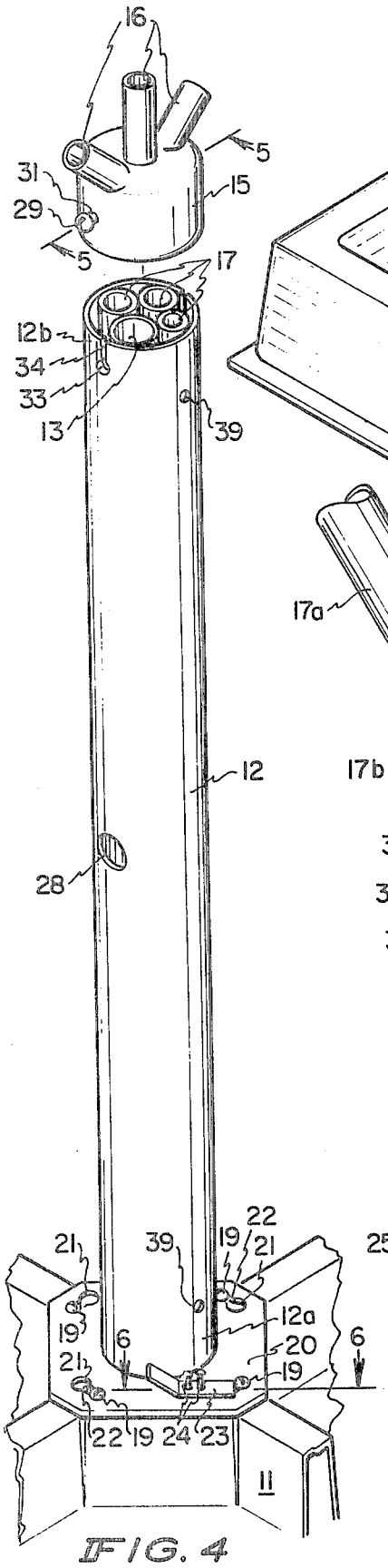
Figure 5:
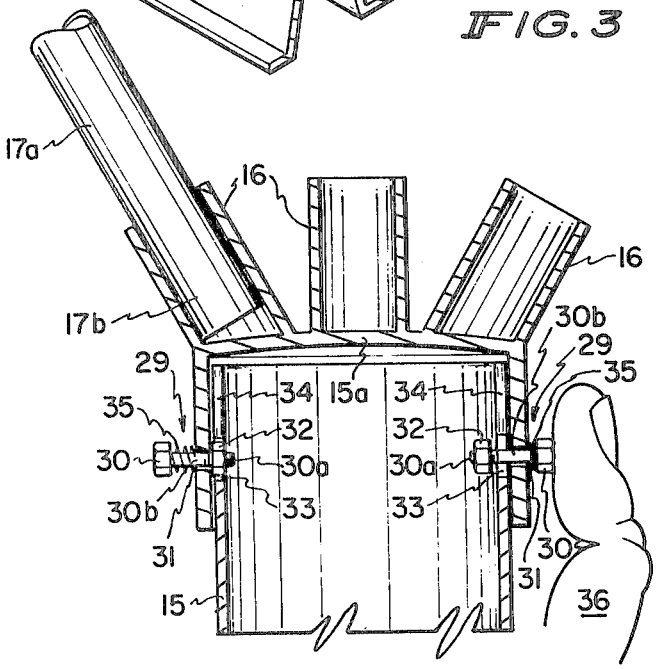
Figure 6:
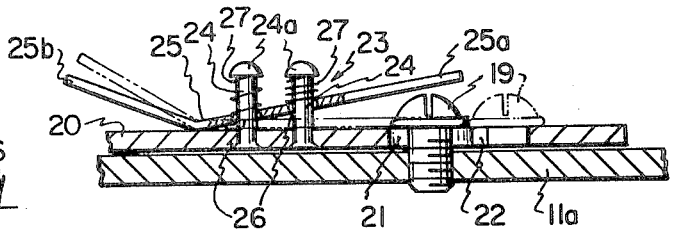

FIG. 4, a side elevation view of the mast of the portable sign of FIG. 1, showing the cap exploded away from the mast top;

FIG. 5, a side elevation sectional view of the cap of FIG. 4, shown installed onto the mast top, taken along the line 5—5 of FIG. 4, and showing a finger depressng a locking pin arrangement thereof, with a broken end of a flagpole shown installed within one of three cups that are secured onto the top of the cap; and, FIG. 6, an expanded profile sectional view of a spring biased locking tab arranged on the mast round flange taken along the line 6—6 of FIG. 4, showing, in broken lines, the end of the locking tab lowered behind a screw head that extends out of the base, that screw head having traveled along a groove in the round flange when the round flange is rotated appropriately, the locking tab end having been lowered behind the screw head by its spring biasing, when the screw head reaches the closed end of the groove.

DETAILED DESCRIPTION

Referring now to the drawings:

In FIG. 1, is shown a preferred embodiment of a portable sign 10, of the present invention, hereinafter referred to as sign. The sign, as shown in FIG. 1, consists of a base 11 mounting, at the center thereof, a mast 12 that is connected to stand upright at a normal angle to the top horizontal plane of the base. The mast 12, is shown in turn, to have a cross arm 13 arranged therewith to extend across the mast at approximately its center, the cross arm forming a normal angle to the vertical plane of the mast. A sign display portion 14, is shown connected at its corners to, respectively, the mast 12 and cross arm 13, so as to extend across the mast and cross arm to display single or multiple letters, numbers, symbols, characters, or the like, thereon. In FIG. 1, the sign display portion 14 is shown as having the word STOP arranged thereon formed by individual letters 44. On a top end **12*b* of the mast 12, in FIG. 1, is shown a cap 15. Cap 15** has a cup or preferrably cups 16 secured at base ends thereof to the cap top so as to extend outwardly therefrom, for maintaining, as shown in FIG. 5, ends 17*b* of flagpoles 17*a* of flags 17 therein.

Figure 3:
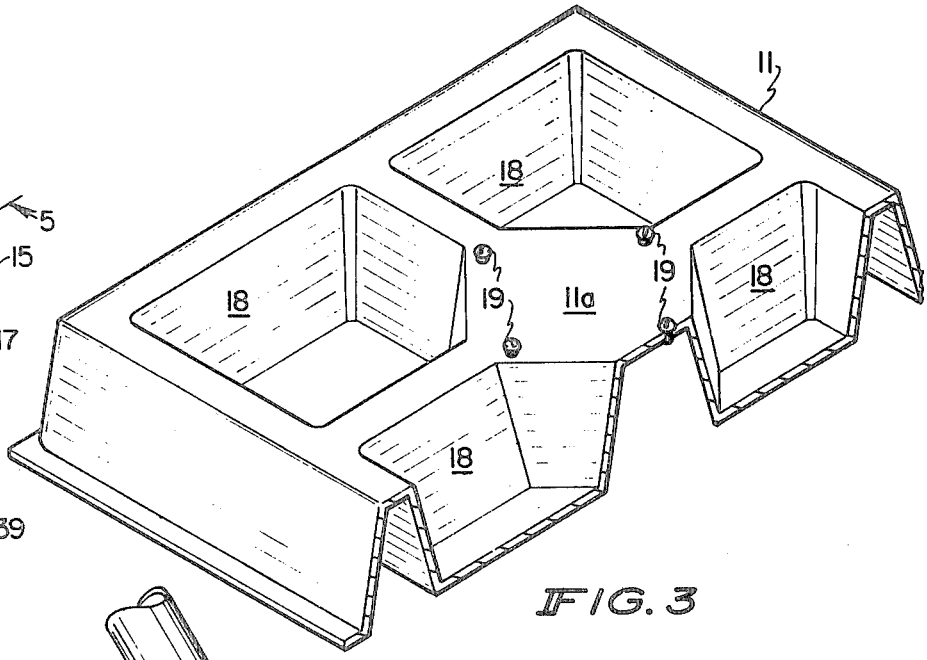
FIG. 3, is a profile sectional view of the base of the portable sign, taken along the line 3—3 of FIG. 1.

Shown in FIG. 1, and in the sectional view of FIG. 3, the base 11 is formed, preferrably by molding or stamping methods, from glass fiber and resin, thermoplastic material, metal or the like, in a square configuration though any shape such as rectangular, hexagonal, octagonal, round, or the like, could be utilized so long as the base will rest on a flat horizontal plane. The base 11 is preferrably formed so as to have a number of cups, pockets, or recess 18, formed therein, that surround a flat center portion 11*a*. The cups 18 are intended to receive sand, rocks, or other types of ballast material installed therein to weight the base such that it will provide an effective ground anchor resistive of toppling when a wind load is applied thereto through on the sign display portion. As shown best in FIG. 3, base 11 is preferrably manufactured from a thin material, such as, but not necessarily limited to, one of the materials mentioned above, and is formed so as to be capable of being nested for storage and transported with like bases.

Shown also in FIG. 3, the base 11 has a number of screw, bolt, or like headed devices 19, hereinafter referred to as screw heads, arranged in the base flat center portion 11*a* spaced apart equidistantly approximately 90° from one another around the flat center portion 11*a*. Screw heads 19 are shown to extend a short distance upwardly from the top surface of the flat center portion 11*a* and are for coupling with a round flange 20, shown in FIGS. 1, 4, and 6, that is attached across a base end 12*a* of the mast 12. Shown best in FIG. 4, the mast 12 is connected to the center of round flange 20 to extend at a normal angle vertically therefrom. Arranged in round flange 20, as shown in FIG. 4, at approximately 90° intervals from one another around the center of round flange 20, so as to align with the screw heads 19, are arranged eyelet holes 21 that individually intersect with keyways 22 formed through the round flange 20 extending between radials from the round flange center.

Shown best in FIG. 4, the round flange 20 is installed to the base 11 by aligning the eyelet holes 21 with screw heads 19 that project from the base flat center portion 11*a*. Whereafter, to lock the round flange 20 to the base 11, the round flange is rotated such that the undersurfaces of the screw heads 19 slide over the opposite edges of the individual keyways 22, the individual screw heads finally contacting the ends of the individual keyways opposite to the individual eyelet holes 21. The round flange 20 is thereby held by the undersurfaces of the screw heads 19 to the base flat center portion 11*a*. To releasably lock the round flange 20 to the base 11, the invention further involves a locking tab 23, described hereinbelow to prohibit opposite rotation of round flange 20 with respect to base 11, that would realign screw heads 19 with eyelet holes 21.

A preferred locking tab 23 for releasably maintaining round flange 20 to base 11, is shown in FIG. 6. Therein, the round flange 20 and base flat center portion 11*a* are shown broken away having a screw head 19 extending upwardly from that base flat center portion, with round flange 20 having posts 24 secured therethrough extending above the top face thereof. Each post 24 is shown having a round head 24*a* secured to its top end. So arranged, the screw head 19, shown in solid lines, is fitted through an eyelet hole 21 in round flange 20, and, in broken lines, that screw head is shown having traveled over the opposite edges of the keyway 22, intersecting the closed end thereof.

Passage of the screw head 19 through the eyelet hole 21 causes a tab 25 of the locking tab 23 to be elevated at its end 25*a* by screw head 19 as it passes through the eyelet hole 21. The tab 25 is connected, in floating arrangement, to the round flange 20, top surface by installation of posts 24 through holes 26 formed through the tab 25. Holes 26 are of lesser diameter than the individual post round heads 24*a*. The tab 25 is biased by coil springs 27 that are fitted around posts 24 so as to urge the tab 25 undersurface against the top surface of round flange 20, which biasing is overcome, as shown in FIG. 6, by passage of a screw head 19 through an individual eyelet hole 21 contacting the tab 25 undersurface.

After screw head 19 has passed through eyelet hole 21, elevating tab 25, as shown in FIG. 6, rotation of round flange 20 moves the screw head along the opposite edges of the keyway 22, and causes also the screw head 19 top surface to travel along the undersurface of the tab 25. The tab 25 is spring biased against that screw head, and will travel downwardly to contact the round flange 20 when the screw head passes beyond the tab end 25*a* to the attitude shown in broken lines in FIG. 6. In that attitude, the tab end 25*a* is stationed behind the screw head 19, prohibiting a reverse rotation of round flange 20 that would again align the screw head 19 with the eyelet hole 21.

Release of the round flange 20 from base 11 is, of course, a reverse of the above description with the addition of an operator, not shown, with his foot or hand, depressing a tab 25 bent end 25*b* to elevate the tab end 25*a* away from the screw head 19 so as to allow for a reverse rotation of round flange 20 to align the screw heads 19 with eyelet holes 21, whereafter the mast 12 with connected round flanges can be lifted off from the base 11.

Figure 2:
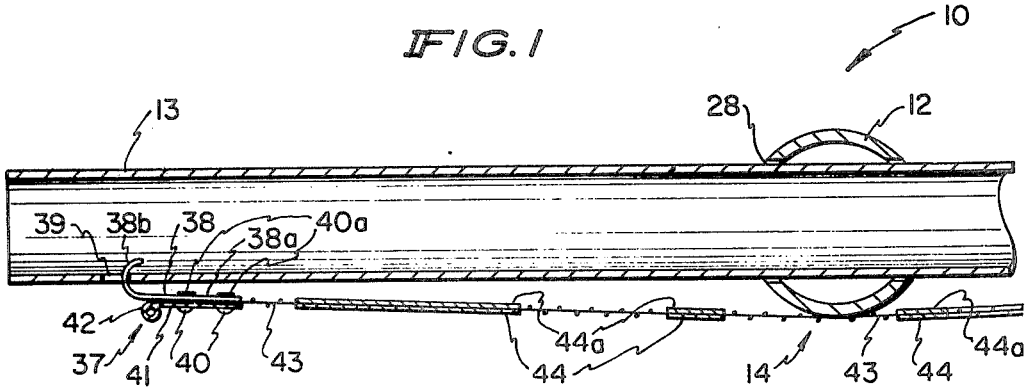
FIG. 2 is a top plan sectional view taken along a line 2—2 of FIG. 1, showing a cross arm and part of the sign display portion broken away.

Continuing up the mast 12, from the base end 12*a* thereof, as shown in FIG. 4, a hole 28 is shown formed through the mast at approximately its midpoint. Hole 28, shown best in FIG. 2, is intended to receive the cross arm 13 installed therethrough such that the cross arm ends are approximately equidistant from one another, each forming approximately a normal angle to the mast, as shown in FIG. 1. In FIG, 2, which is a sectional view taken at approximately the midpoint of the sign 10, both the mast 12 and cross arm 13 are shown to be preferrably fabricated from tube or pipe material, such as a plastic pipe, reinforced plastic or metal material, or the like, that is inexpensive and light in weight. While, as shown in FIG. 2, both the mast 12 and cross arm 13 are preferrably round tube or pipe, square tubing, solid stock, or the like could be used for one or both units without departing from the subject matter of the present invention disclosed herein.

Referring to FIGS. 2 and 4, as stated earlier herein, the mast 12 is preferrably hollow to accomodate a number of components of the invention installed therein. FIG. 4, shows how the hollow mast 12 can maintain, for storage and transport, flags 17, individually rolled upon their flagpoles 17*a*, the cross arm 13, and, if the mast 12 were found appropriately so as to be large enough, the preferred flexible sign display portion 14 could be rolled upon itself to also be installed therein. These components are intended to be maintained within the mast 12 by installation of the cap 15, onto the mast top end 12*b*.

Referring to FIG. 5, which is a profile sectional view of the cap 15, a broken away flagpole end 17*b* is shown installed in one of the cups 16 that are secured to the cap top 15*a* so as to project upwardly therefrom. The cap 15 preferabbly incorporates two individual pin arrangements 29 that are positioned across from one another in the side wall of cap 15 thereof. One such pin arrangement 29 could, however, be used to securely maintain the cap 15 to mast 12, though two are preferred. It should also be understood that a description of one pin arrangement 29 is to be taken as being the same for the other.

The pin arrangement 29, as shown in FIG. 5, consists of a bolt 30, or like headed device, whose threaded end 30*a* is fitted through a hole 31 formed in the cap wall. A nut 32 is turned onto the bolt threaded end 30*a*, which nut 32 has a diameter that is less than the diameter of a hole 33, FIGS. 4 and 5, formed through the mast 12, but has a greater diameter than the distance across a longitudinal slot 34 that extends upwardly from the hole 33 to the mast top end 12*b*. The slot 34 being intended to accomodate the body 30*b* of bolt 30 traveling therealong. Shown best in FIG. 5, the head of bolt 30 is biased away from the cap 15 wall by a coil spring 35 that is arranged around the bolt body 30*b* between the head and outer surface of the cap wall. So arranged, when the head of bolt 30 is moved towards the cap wall, as by a finger 36 pushing thereagainst, the nut 32 moves out of the hole 33 in mast top end 12*b*, allowing the bolt body 30*b* to travel upwardly along the slot 34, to lift the cap 15 upwardly off from the mast top end 12*b*. Installation of which cap 15 is the opposite procedure to that described above consisting of, depressing the head of bolt 30 towards the cap wall, against the biasing of coil spring 35, moving the bolt body 30*b* downwardly along the slot 34 until the hole 33 is reached. Whereat, the pressure exerted by finger 36 on the head of bolt 30 is released and the coil spring biases the bolt outwardly from the cap wall until the nut 32 seats itself in the hole 33, thereby locking the cap 15 to the mast top end 12*b*.

Referring to FIG. 1, with the cap 15 installed to the mast 12 top end 12*b*, as hereinabove described, the ends 17*b* and the flagpoles 17*a* can be installed onto caps 16. Also shown in FIG. 1, to erect the mast 12 and cross arm 13 so as to support the sign display portion 14, the cross arm 13 is first installed through the hole 28 in mast 12. Sign display portion installation is thereafter accomplished, as shown in FIG. 2, by insertion of a hook end 38*b* of a hook 38 into one of the openings 39 that are formed near to the ends of the mast 12 and cross arm 13. Each such hook 38 is part of a sign display portion connector 37, one such sign display portion connector 37 being, as shown in FIG. 1, attached to each corner of the sign display portion 14. Each sign display portion connector 37 that is secured to each corner of the sign display portion 14 should be taken as being identical to the other, each fitting indentically into one of the openings 39. Installation of the sign display portion connector 37 to the sign display portion corner, as shown in FIG. 2, is accomplished by installation of bolts 40 through a front plate 41, of the sign display portion connector 37. Bolts 40 pass also through the sign display portion corner and through a body portion 38*a* of the hook 38. Nuts 40*a* are then turned over threaded portions of the bolts 40, to sandwich the sign display portion corner between said plate 41 and hook body portion 38*a*. Shown also in FIG. 2, the front plate 41 has a ring 42 formed in the end thereof adjacent to the hook end 38*b*, for gripping by an operator, not shown, as with his fingers, to assist him in stretching the sign display portion 14 corner between the holes 39 in the cross arm 13 and mast 12 until the hook end 38*b* can be fitted therein. The stretching of the sign display portion 14, it should be understood, causes a slight lengthening of that sign display portion so as to allow the end of hook end 38*b* to fit within a hole 39.

Referring to FIG. 2, the sign display portion 14 preferrably consists of a background 43 that is made from a material having a profusion or large number of holes formed therethrough such as an open weave or perforated material, colored as desired, that is preferrably flexible, but may, of course, be rigid, which background may be knitted, or woven, from any variety of metal, synthetic, or natural fibers. The porous nature of background material 43 facilitates air passage therethrough. By providing for passage of air through the background 43 of the sign display portion minimizes wind loads exerted thereon that could possibly topple the portable sign 10. While the preferred background 43 is one having holes formed therethrough, it should be obvious that a solid background could be used for the sign display portion 14 without departing from the subject material coming within the scope of this disclosure.

Shown in FIG. 1, the background 43 has individual letters 44 attached thereto that spell out the word STOP. Obviously, other combinations of letters, numbers, symbols, characters, or the like, could be attached to the background 43, with such attachment, as described hereinbelow, is intended to be permanent.

Attachment of letters 44, to the background 43, as shown in FIG. 2, is accomplished by placing each letter onto the background 43 aligning a backing letter 44*a* behind that letter with the background therebetween. Each such letter 44 and backing letters 44*a*, may be formed from pure gum rubber, synthetic rubber, plastic material, or the like, and may be uncured, semi-cured, and may or may not have an adhesive backing, may be cut from a sheet stock or may be formed from an extrudable consistance, and may be any color. Thereafter, with each letter 44 aligned in back to back relationship, with its matching backing letter 44*a*, with the background 43 therebetween, pressure is applied by means of roll, press, or impact device, not shown, to force the materials of the letters 44 and backing letter 44*a* together and encapsulating the backing 43 therebetween. Heat may be applied to the letters and backing letters during the bonding process to facilitate the flow of material or adhesive through the background 43.

While a cap 15 having cups 16 secured thereto to receive flags 17, has been shown herein as a preferred embodiment, it should be obvious that such cups and flags could be dispensed with without departing from the subject matter of this invention. Further, while a preferred locking arrangement for maintaining the round flange 20 to the base 11, has been shown herein as the locking tab 23, other releasable locking arrangements for binding against one or more of the screw heads after appropriate rotation of round flange 20 could obviously be substituted for locking tab 23 without departing from the subject matter coming within the scope of the present invention. Such locking arrangement could, as an example, consist of a tab, not shown, mounted to the top of the round flange 20 as to be capable of rotating across the path of the screw head 19 after it has passed along the keyway 22 locking thereby that screw head within the keyway 22 until that tab is rotated out of engagement therewith. Therefore, while the present invention preferrably involves the described locking tab 23 for maintaining the round flange 20 to the base 11, the present invention should not be taken as being limited to that described locking tab 23.

While plastic tube or pipe, reinforced plastic, or metal have been listed as preferred materials for constructing the mast 12 and cross arm 13, obviously a solid stock material, could be used in their construction.

Although a preferred embodiment of my invention has been herein disclosed, it is to be understood that the present disclosure is made by way of example, and that variations are possible without departing from the subject matter within the scope of the following Claims, which subject matter I regard as my invention.

I claim:

1. A portable sign comprising, a base constructed so as to be capable of being nested with a like base;

a mast, arranged to be releasably connected at its base end to said base in a vertical attitude, extending upwardly therefrom;

means for releasably connecting said mast, at its base end, to said base;

means for releasably locking the base end of said mast to said base;

a cross arm installable to said mast to extend across said mast;

means for releasably installing said cross arm to said mast;

a sign display portion for arrangement across said mast and cross arm; and, means for releasably connecting said sign display portion across said mast and cross arm.

2. A portable sign as recited in claim 1, wherein the base is formed so as to have a plurality of spaced apart recesses formed therein around aa flat center portion; and, a plurality of spaced apart headed devices are installed to said base flat center portion so as to extend upwardly therefrom.

3. A portable sign as recited in claim 2, wherein the means for releasably connecting said mast, at its base end, to said base consists of, a round flange secured across the base end of said mast, which round flange has a plurality of holes formed therethrough that will align with, to pass therethrough, the heads of the headed devices that extend upwardly from the base flat center portion when said mast is appropriately aligned over said base, which plurality of holes each have a keyway connected thereto that extends through said round flange, the width of each keyway being less than the diameter of the head of the said headed device and greater than the body thereof to accomodate the headed device body traveling therein when said round flange is rotated.

4. A portable sign as recited in claim 3, wherein the means for releasably locking said mast to said base consists of, a tab means arranged with the round flange so as to extend across one of the keyways for intersecting one of the headed devices, when such headed device is installed therein, to bind against said headed device restricting rotation of said round flange, which tab means can be moved, as desired, into and out of engagement with said headed device restricting and allowing travel of said headed device along said keyway.

5. A portable sign as recited in claim 4, wherein the tab means consists of;

a tab maintained in floating arrangement to the round flange such that its one end extends over one of the holes formed therethrough, aligned therewith so as to elevate when a headed device passes therethrough; and, post means connected to said round flange and passing through said tab for maintaining said tab in floating arrangement with said round flange;

biasing means for urging said one end of said tab towards said round flange; and, means for elevating said tab one end away from said round flange so as to allow said headed device to pass thereunder.

6. A portable sign as recited in claim 5, wherein, the other end of the tab opposite to its one end is upturned.

7. A portable sign as recited in claim 1, further including, the mast has a longitudinal center cavity formed therein;

a cap installable over the top end of said mast; and, means for releasably connecting said cap to said top end of said mast so as to close off said longitudinal center cavity.

8. A portable sign as recited in claim 7, wherein, the means for installing said cross arm to said mast consists of, a hole formed through said mast across approximately its midpoint to receive said cross arm slid therethrough.

9. A portable sign as recited in claim 7, wherein, the cap has an upturned cup secured to the top thereof, the open end of said cup facing upwardly to receive the end of a flagpole therein.

10. A portable sign as recited in claim 7, wherein the means for releasably connecting said cap to said top end of said mast so as to close off said longitudinal center cavity consists of, a pin arrangement having a headed end and a body portion, said body portion maintained in sliding arrangement in an appropriate hole formed through the side of said cap such that said headed end is within said cap;

means for maintaining in sliding arrangement said headed end and body portion within said cap;

biasing means for urging said headed end towards the inner wall of said cap;

in the mast, proximate to the top end thereof, forming a longitudinal slot of sufficient width to allow for free passage of said pin arrangement body portion therealong; and, in the mast, intersecting said keyway, forming a hole therethrough of sufficient diameter to allow for free passage of said headed end of said pin arrangement in sliding arrangement within said cap.

11. A portable sign as recited in claim 1, wherein the sign display portion consists of, a background formed from a section of open weave material; and, a symbol secured to said material.

12. A portable sign as recited in claim 1, wherein the sign display portion consists of, a background formed from a section of perforated material; and, a symbol secured to said perforated material.

13. A portable sign as recited in claim 1, wherein the means for releasably connecting said sign display portion across said mast and cross arm consists of, a plurality of spaced apart hook means, each connected strategically to said sign display portion for maintaining said sign display portion across said mast and cross arm in an extended attitude; and, holes formed strategically in said mast and cross arm each for receiving one said hook means therein.

14. A portable sign as recited in claim 13, further including, a ring means secured to the hook means for manual engagement to stretch the sign display portion so as to install each hook means into one of the holes formed strategically in the mast and cross arm.

* * * * *